US011179779B2

(12) United States Patent
Gao et al.

(10) Patent No.: US 11,179,779 B2
(45) Date of Patent: Nov. 23, 2021

(54) FLEXIBLE POROUS METAL FOIL AND MANUFACTURING METHOD FOR FLEXIBLE POROUS METAL FOIL

(71) Applicant: Internet Technologies Chengdu Co., Ltd., Sichuan (CN)

(72) Inventors: Lin Gao, Chengdu (CN); Tao Wang, Chengdu (CN); Tao Wang, Chengdu (CN); Bo Li, Chengdu (CN)

(73) Assignee: Intermet Technologies Chengdu Co., Ltd., Sichuan (CN)

( * ) Notice: Subject to any disclaimer, the term of this patent is extended or adjusted under 35 U.S.C. 154(b) by 1055 days.

(21) Appl. No.: 15/562,561

(22) PCT Filed: Mar. 30, 2016

(86) PCT No.: PCT/CN2016/077821
§ 371 (c)(1),
(2) Date: Mar. 5, 2018

(87) PCT Pub. No.: WO2016/155621
PCT Pub. Date: Oct. 6, 2016

(65) Prior Publication Data

US 2018/0161880 A1 Jun. 14, 2018

(30) Foreign Application Priority Data

Apr. 1, 2015 (CN) ..... 201510153116.3

(51) Int. Cl.
*B22F 5/00* (2006.01)
*B22F 1/00* (2006.01)
(Continued)

(52) U.S. Cl.
CPC ..... *B22F 5/006* (2013.01); *B22F 1/0059* (2013.01); *B22F 1/0062* (2013.01); *B22F 3/16* (2013.01);
(Continued)

(58) Field of Classification Search
CPC ..... B22F 5/006; B22F 1/0059; B22F 3/16; B22F 3/11
See application file for complete search history.

(56) References Cited

U.S. PATENT DOCUMENTS 5,625,861 A * 4/1997 Nishi ..... B01D 39/2034 419/2
6,652,804 B1 * 11/2003 Neumann ..... C23C 24/085 419/2
(Continued)

FOREIGN PATENT DOCUMENTS

| | | | |
|---|---|---|---|
| CN | 204051114 | U | 12/2014 |
| JP | 2001040402 | A | 2/2001 |
| SU | 592523 | A1 | 2/1978 |

*Primary Examiner* — Nicholas A Wang
*Assistant Examiner* — Jiangtian Xu
(74) *Attorney, Agent, or Firm* — Mersenne Law

(57) ABSTRACT

A flexible porous metal foil sheet made of a metal porous material which use a solid solution alloy, a metal element of a face-centered cubic structure or a metal element of a body-centered cubic structure as the matrix phase, wherein the thickness of the sheet is greater than 200 μm and less than or equal to 1500 μm, the average aperture is 0.05~100 μm, and the porosity is 15%~70%. The method for making the flexible porous metal foil comprises: (1) making viscous suspension or muddy paste of raw material powder that will form the metal porous material using a dispersing agent and a binding agent; (2) injecting the suspension or paste into a mold for making membrane, and drying the suspension or paste to form a homogeneous membrane; (3) pressing the membrane to improve the stacking density of the powder particles; and (4) sintering the pressed membrane to obtain the flexible porous metal foil. The flexible porous metal foil has more uniform aperture distribution, and better flatness of the foil.

4 Claims, 1 Drawing Sheet

(51) Int. Cl.
*B22F 3/22* (2006.01)
*B22F 3/16* (2006.01)
*B22F 3/11* (2006.01)

(52) U.S. Cl.
CPC ..... *B22F 3/225* (2013.01); *B22F 3/11* (2013.01); *B22F 2301/10* (2013.01); *B22F 2301/15* (2013.01); *B22F 2998/10* (2013.01)

(56) References Cited

U.S. PATENT DOCUMENTS

2002/0195188 A1* 12/2002 Kuhstoss ..... B01D 67/0041 156/89.16
2006/0222554 A1* 10/2006 Singh ..... C22C 33/0207 419/32
2007/0202001 A1* 8/2007 Stournaras ..... B01D 39/2044 419/9
2011/0155662 A1* 6/2011 Liu ..... B01D 67/0046 210/510.1

* cited by examiner

FLEXIBLE POROUS METAL FOIL AND MANUFACTURING METHOD FOR FLEXIBLE POROUS METAL FOIL

The applicant of the present invention filed Invention Patent Application No. 2014106089803 (in China) on Oct. 31, 2014, entitled "FLEXIBLE POROUS METAL FOIL AND PREPARATION METHOD THEREFOR". The disclosure of porous metal foil and the method of manufacturing of such flexible porous metal foil in the specification of the prior application may be technically related to the present application. Because the prior application has not been published at the time the present application is filed, the following content of the present specification involves in a lot of content of the prior application, in order to comprehensively and clearly apprise the public of flexible porous metal foil and preparation method thereof.

FIELD OF THE INVENTION

The present invention relates to a sintered metal porous material and preparation thereof, and specifically relates to a flexible porous metal foil and a preparation method of the flexible porous metal foil.

BACKGROUND

The sintered metal porous material is mainly used as a filter material. In specific application, the sintered metal porous material is made into a filter element in certain shape and structure, and then the filter element is installed into a filter device. The existing sintered metal porous material filter elements are substantially of a rigid tubular or plate-type structure. Their preparation principles are similar, i.e., roughly, raw material powder constituting the metal porous material is pressed into a tubular or plate-type pressed blank via a special mold (generally adopting an isostatic press molding technology), and then the pressed blank is sintered to obtain a product.

The application range of the above tubular or plate-type sintered metal porous material filter element is limited under the influence of its shape, structure and corresponding appended requirements for the filter device and system. Because the sintered metal porous material filter element has stronger advantages than the present filter element (e.g., organic filter membrane) on the aspects of chemical erosion resistivity, material irreversible pollution resistivity, mechanical strength and the like, it is significant to develop a novel sintered metal porous material filter element capable of correspondingly substituting original filter elements in many fields.

Based on the background, the applicant creatively proposed and developed a flexible porous metal foil, i.e., a sheet which is made of a metal porous material, can be bent relatively freely and even can be folded.

The paper "Research Development on Ti—Al Intermetallic Compound Porous Material, Jiang Yao et al., Chinese Material Development, Vol. 29, No, 3, March 2010" in section 2.3 describes a preparation process of a Ti—Al intermetallic compound paper membrane. The paper membrane made of a Ti—Al intermetallic compound is still a rigid material.

SUMMARY OF THE INVENTION

The present invention provides several flexible porous metal foils and preparation methods of the flexible porous metal foils first, then provides several preparation methods of the porous metal foils (flexible and rigid), and further provides a membrane making fixture for the methods.

The first flexible porous metal foil provided by the present invention is a sheet made of a porous metal material using a solid solution alloy, a face-centered cubic metal element or a body-centered cubic metal element as the matrix phase, the thickness of the sheet is 5~200 μm, the average aperture is 0.05~100 μm, the porosity is 15~70%, and the sheet is formed by sintering a homogeneous membrane. Specifically, firstly, the flexible porous metal foil is made of metal using a solid solution alloy, a face-centered cubic metal element or a body-centered cubic metal element as the matrix phase, so that the flexibility of the flexible porous metal foil is ensured. Secondly, the metal material for forming the flexible porous metal foil shall be a porous material, and its pore structure is characterized in that the average aperture is 0.05~100 μm and the porosity is 15~70%, so that the flexible porous metal foil can meet extensive requirements of filtration and separation. In addition, the thickness of the flexible porous metal foil (sheet) is 5~200 μm, generally 10~60 μm. More importantly, the flexible porous metal foil is formed by sintering a homogeneous membrane. The so-called "homogeneous" expresses that the components of the membrane are roughly uniform, i.e., substantially differs from the aluminum foil after coating and before reactive synthesis as mentioned in the background "Research Development on Ti—Al Intermetallic Compound Porous Material". The aluminum foil after coating and before reactive synthesis can be understood as an asymmetrical sheet. The meaning of "asymmetrical" in the field of sintered metal porous materials is general. The "homogeneous" in the present invention is a distinguishing concept proposed relative to "asymmetrical". Since the flexible porous metal foil of the present invention is formed by sintering a homogeneous membrane, the foil is more uniform in aperture distribution, better in flatness and the like.

The sheet may be made of a metal porous material using an infinite solid solution alloy as the matrix phase. For example, the sheet is made of a metal porous material using Ag—Au solid solution. Ti—Zr solid solution, Mg—Cd solid solution or Fe—Cr solid solution as the matrix phase. For another example, the sheet is preferably made of a Ni—Cu solid solution metal porous material, which can require that the aperture differences of more than 75% of numerous pores of the porous material are in the range of less than 70 μm. In addition, the Ni—Cu solid solution metal porous material is relatively ideal on the aspects of flexibility (can be folded multiple times), chemical stability and the like, and the permeability of the sintered porous material is also excellent, so the application range is relatively wide.

The sheet may also be made of a metal porous material using a finite solid solution alloy as the matrix phase. For example, the sheet is made of a metal porous material using Cu—Al solid solution, Cu—Zn solid solution or Fe—C—Cr solid solution as the matrix phase. The sheet may also be made of a metal porous material having a face-centered cubic structure and using Al, Ni, Cu or Pb as the matrix phase. The sheet may also be made of a metal porous material having a body-centered cubic structure and using Cr, W, V or Mo as the matrix phase.

The above flexible porous metal foil of the present invention has a wide application space, e.g., in industry, can be used for waste heat recovery, agent recovery and pollution control in the textile and leather industry, purification, concentration, disinfection and byproduct recovery in the food processing industry, artificial trachea, controlled release, blood filtration and water purification in the medicine and health-care industry and filters in the vehicle industry, and in civil use, can be used as a dust filtration material of masks and a curtain material having an electrostatic dust collection function.

A preparation method of the above flexible porous metal foil of the present invention includes the steps of: (1) preparing a viscous suspension from raw material powder constituting a metal porous material by using a dispersing agent and a binding agent; (2) injecting the suspension into a mold cavity of a membrane making fixture, and drying the suspension to form a homogeneous membrane; and (3) charging the membrane into a sintering fixture matched with the membrane in shape, then performing constrained sintering, and taking the flexible porous metal foil out of the sintering fixture and obtaining the foil after sintering.

In the above method, if the flexible porous metal foil is made of a metal porous material of Ni—Cu solid solution, in order to prepare a high-performance Ni—Cu flexible porous metal foil, in step (1), Ni powder and Cu powder are mixed uniformly first to form raw material powder, wherein the mass of the Cu powder is 30~60% of that of the raw material powder, then PVB (Polyvinyl Butyral) serving as a binding agent is added into ethanol serving as a dispersing agent in a mass ratio of PVB to ethanol being (0.5~5):100 to form a PVB solution, next, the raw material powder is added into the PVB solution according to a proportion of adding 20~50 g of raw material powder into per 100 ml of ethanol, the raw material powder is dispersed uniformly by stirring, and a viscous suspension is thus obtained; and in step (3), the sintering process includes a first sintering phase of gradually raising the sintering temperature to 520~580° C. and holding 60~180 mins and a second sintering phase of directly raising the temperature to 1130~1180° C. at the heating rate of ≥5° C./min after the first phase and holding 120~300 mins.

The membrane making fixture available for the above method includes a fixing portion, an adjusting portion and a movable portion, wherein the fixing portion includes a mold frame for forming the edge of the membrane; the adjusting portion includes a template matched with the mold frame and used for forming the bottom of the membrane, and the template is connected with adjusting devices enabling the template to move in the depth direction of the mold frame; and the movable portion includes a scraper positioned at the top surface of the mold frame and having the cutting edge flush with the top surface of the mold frame in the working process. The membrane making fixture can control the thickness of the membrane relatively accurately, and ensures the thickness uniformity and surface flatness of the membrane.

As a specific embodiment of the adjusting device, the adjusting device includes a height adjusting mechanism which is fixed relative to the mold frame and connected with one of four corners of the bottom of the template and works independently. The heights of four corners of the template can be adjusted respectively, so that the overall template is ensured to parallel to the top surface of the mold frame, and the thickness uniformity of the membrane is higher.

In addition, a lubricant coating volatile at 580° C. is further arranged on the molding surface of the mold frame and the molding surface of the template. The lubricant coating may be specifically a Vaseline coating. In this case, the molded membrane can be successfully taken out of the membrane making fixture and prevented from being stuck to the mold, and simultaneously, the volatile lubricant coating does not influence the components of the subsequent prepared flexible porous metal foil and is beneficial to improving the porosity of the flexible porous metal foil.

In order to conveniently take the molded membrane out of the membrane making fixture, a PE (Polyethylene) plastic film or a PET (Polyethylene Terephthalate) plastic film may also be laid on the molding surface of the mold frame and the molding surface of the template. After the PE plastic film or the PET plastic film is laid on the molding surfaces, the suspension is added into the mold cavity and dried into a membrane, and the membrane is not stuck with the membrane making fixture, so de-molding is quite convenient.

The membrane sintering fixture available for the above method includes an upper mold, a lower mold and a side mold made of a high temperature resistant material, and the upper mold and the lower mold are respectively matched with the side mold to form the mold cavity matched with the internal membrane; the mold cavity is connected with an exhaust structure for emitting sintered volatile matters, and the exhaust structure is a fit clearance reserved at the fit part of the upper mold and the side mold and/or a fit clearance reserved at the fit part of the lower mold and the side mold and/or an air hole formed in at least one of the upper mold, the lower mold and the side mold. Constrained sintering can be performed on the membrane via the sintering fixture, thus preventing deformation of the membrane in sintering.

As a preferred specific structure of the upper mold, the lower mold and the side mold, the side mold is a mask, the upper mold and the lower mold are respectively clamping plates, at least three layers of clamping plates are installed in the mask, and the mold cavity is formed between any two adjacent layers of clamping plates. In this case, a plurality of membranes can be sintered simultaneously, so that the production efficiency is improved and the sintering consistency is also ensured.

Besides, an alumina coating is further arranged on the surface, contacting the membrane, of each of the upper mold, the lower mold and the side mold. Alumina can block mutual diffusion of elements between the material of the sintering fixture itself and the membrane material during the high-temperature sintering process.

At least one of the upper mold, the lower mold and the side mold can be made of graphite. The graphite has good high temperature resistance, and the graphite having a smooth surface facilitates de-molding of the product after sintering.

The second flexible porous metal foil provided by the present invention is a sheet made of a porous metal material using a solid solution alloy as the matrix phase, the thickness of the sheet is 5~200 μm, the average aperture is 0.05~100 μm, and the porosity is 15~70%. Specifically, the flexible porous metal foil is made of metal using a solid solution alloy as the matrix phase, so that the flexibility of the flexible porous metal foil is ensured. Secondly, the metal material for forming the flexible porous metal foil is a porous material, and its pore structure is characterized in that the average aperture is 0.05~100 μm and the porosity is 15~70%, so that the flexible porous metal foil can meet extensive requirements of filtration and separation. In addition, the thickness of the flexible porous metal foil (sheet) is 5~200 μm, generally 10~60 μm.

The sheet may be made of a metal porous material using an infinite solid solution alloy as the matrix phase. For example, the sheet is made of a metal porous material using Ag—Au solid solution, Ti—Zr solid solution, Mg—Cd solid solution or Fe—Cr solid solution as the matrix phase. For another example, the sheet is preferably made of a Ni—Cu solid solution metal porous material, and the Ni—Cu solid solution metal porous material is relatively ideal on the aspects of flexibility (can be folded multiple times), chemical stability and the like, so the application range is relatively wide.

The sheet may also be made of a metal porous material using a finite solid solution alloy as the matrix phase. For example, the sheet is made of a metal porous material using Cu—Al solid solution, Cu—Zn solid solution or Fe—C—Cr solid solution as the matrix phase.

The above second flexible porous metal foil of the present invention, in industry, can be used for waste heat recovery, agent recovery and pollution control in the textile and leather industry, purification, concentration, disinfection and byproduct recovery in the food processing industry, artificial trachea, controlled release, blood filtration and water purification in the medicine and health-care industry and filters in the vehicle industry, and in civil use, can be used as a dust filtration material of masks and a curtain material having an electrostatic dust collection function.

A preparation method of the second flexible porous metal foil of the present invention includes the steps of: (1) preparing a carrier, wherein the carrier is a foil formed by a certain element or a few elements in a metal porous material for forming the flexible porous metal foil; (2) preparing a viscous suspension from raw material powder of the remaining elements constituting the metal porous material by using a dispersing agent and a binding agent; (3) coating the surface of the carrier with the suspension, and drying the suspension to form a membrane attached to the surface of the carrier; and (4) charging the carrier carrying the membrane into a sintering fixture matched with the carrier in shape, then performing constrained sintering, and taking the flexible porous metal foil out of the sintering fixture.

The membrane making fixture used for the above preparation method of the second flexible porous metal foil includes a fixing portion, an adjusting portion and a movable portion, wherein the fixing portion includes a mold frame for forming the edge of the membrane; the adjusting portion includes a template matched with the mold frame and used for placing the carrier, and the template is connected with adjusting devices enabling the template to move in the depth direction of the mold frame; and the movable portion includes a scraper positioned at the top surface of the mold frame and having the cutting edge flush with the top surface of the mold frame in the working process. The membrane making fixture can control the thickness of the membrane relatively accurately, and ensures the thickness uniformity and surface flatness of the membrane.

As a specific embodiment of the adjusting device, the adjusting device includes a height adjusting mechanism which is fixed relative to the mold frame and connected with one of four corners of the bottom of the template and works independently. The heights of four corners of the template can be adjusted respectively, so that the overall template is ensured to parallel to the top surface of the mold frame, and the thickness uniformity of the membrane is higher.

Similarly, in order to successfully take the molded membrane out of the membrane making fixture, a PE plastic film or a PET plastic film may also be laid on the molding surface of the mold frame and the molding surface of the template. After the PE plastic film or the PET plastic film is laid on the molding surfaces, the suspension is added into the mold cavity and dried into a membrane, and the membrane is not stuck with the membrane making fixture, so de-molding is quite convenient.

The sintering fixture available for the above preparation method of the second flexible porous metal foil includes an upper mold, a lower mold and a side mold made of a high temperature resistant material, and the upper mold and the lower mold are respectively matched with the side mold to form a mold cavity matched with the carrier carrying the membrane; the mold cavity is connected with an exhaust structure for emitting sintered volatile matters, and the exhaust structure is a fit clearance reserved at the fit part of the upper mold and the side mold and/or a fit clearance reserved at the fit part of the lower mold and the side mold and/or an air hole formed in at least one of the upper mold, the lower mold and the side mold. Constrained sintering can be performed on the carrier carrying the membrane via the sintering fixture, thus preventing deformation of the membrane in sintering.

As a preferred specific structure of the upper mold, the lower mold and the side mold, the side mold is a mask, the upper mold and the lower mold are respectively clamping plates, at least three layers of clamping plates are installed in the mask, and the mold cavity is formed between any two adjacent layers of clamping plates. In this case, a plurality of carriers carrying membranes can be sintered simultaneously, so that the production efficiency is improved and the sintering consistency is also ensured.

Besides, an alumina coating is further arranged on the surface, contacting the membrane, of each of the upper mold, the lower mold and the side mold. Alumina can block mutual diffusion of elements between the material of the sintering fixture itself and the membrane material during the high-temperature sintering process.

At least one of the upper mold, the lower mold and the side mold can be made of graphite. The graphite has good high temperature resistance, and the graphite having a smooth surface facilitates de-molding of the product after sintering.

It should be pointed out that the membrane making fixture and the sintering fixture used in the preparation method of the second flexible porous metal foil can be completely same as those used in the preparation method of the first flexible porous metal foil in structure, and the difference lies in that the carrier is placed on the template when the membrane making fixture for the second method is used, whereas a carrier is not placed on the template when the membrane making fixture for the first method is used, placed in the mold cavity of the sintering fixture for the second method is the carrier (having an asymmetrical structure) carrying the membrane, whereas placed in the mold cavity of the sintering fixture for the first method is the homogeneous membrane.

The third flexible porous metal foil of the present invention is a sheet made of a metal porous material using a solid solution alloy, a face-centered cubic metal element or a body-centered cubic metal element as the matrix phase, the thickness of the sheet is more than 200 μm and less than or equal to 1500 μm, the average aperture is 0.05~100 μm, and the porosity is 15~70%. The third flexible porous metal foil can be prepared by using the preparation method of the first flexible porous metal foil (i.e., sintered from a homogeneous membrane). When the third flexible porous metal foil is a sheet made of a metal porous material using a solid solution alloy as the matrix phase, the third flexible porous metal foil can also be prepared by using the preparation method of the second flexible porous metal foil.

The sheet constituting the third flexible porous metal foil may be made of a metal porous material using an infinite solid solution alloy as the matrix phase. For example, the sheet is made of a metal porous material using Ag—Au solid solution, Ti—Zr solid solution, Mg—Cd solid solution or Fe—Cr solid solution as the matrix phase. For another example, the sheet is preferably made of a Ni—Cu solid solution metal porous material, which can require that the aperture differences of more than 75% of numerous pores of the porous material are in the range of less than 70 μm. In addition, the Ni—Cu solid solution metal porous material is relatively ideal on the aspects of flexibility (can be folded multiple times), chemical stability and the like, and the permeability of the sintered porous material is also excellent, so the application range is relatively wide.

The sheet constituting the third flexible porous metal foil may also be made of a metal porous material using a finite solid solution alloy as the matrix phase. For example, the sheet is made of a metal porous material using Cu—Al solid solution, Cu—Zn solid solution or Fe—C—Cr solid solution as the matrix phase. The sheet may also be made of a metal porous material having a face-centered cubic structure and using Al, Ni, Cu or Pb as the matrix phase. The sheet may also be made of a metal porous material having a body-centered cubic structure and using Cr, W, V or Mo as the matrix phase.

The third flexible porous metal foil is thicker than the above first flexible porous metal foil and the second flexible porous metal foil, thus, the strength of the third flexible porous metal foil can be higher than that of the first flexible porous metal foil and the second flexible porous metal foil, so in application, the third flexible porous metal foil is more suitable for the occasions requiring high strength. The third flexible porous metal foil is made into a filter bag for filtering as a typical application example. The filter bag is universally applied to a filter bag type dust collector. The bag body of the existing filter bag is mostly woven from organic fibers, so the filter bag is also referred to as a "cloth bag", having the shortcomings of poor high temperature resistance, low filtration precision and the like. The present invention will provide a filter bag for filtering, the filter bag includes a bag body, the bag body is made of the above third flexible porous metal foil, and the third flexible porous metal foil having high strength is unlikely to quickly damage due to the factors such as frequent back blowing and the like in the using process of the filter bag and simultaneously has good high temperature resistivity due to its material properties.

Besides the above preparation methods of the flexible porous metal foils, the present invention further provides following several improved preparation methods of flexible porous metal foils, which can be used for preparing the above flexible porous metal foils and other porous metal foils. One improved preparation method of a porous metal foil which is a sheet made of a metal porous material includes the steps of (1) preparing a viscous suspension from raw material powder constituting the metal porous material by using a dispersing agent and a binding agent; (2) injecting the suspension into a mold cavity of a membrane making fixture, and drying the suspension to form a homogeneous membrane; (3) pressing the membrane to improve the stacking density of powder particles in the membrane; and (4) sintering the pressed membrane to obtain the porous metal foil. The method can be used for preparing the first flexible porous metal foil, the second flexible porous metal foil and the third flexible porous metal foil above. Through step (3) of pressing the membrane to improve the stacking density of powder particles in the membrane (by adopting a roll mill, a mold press, an isostatic press or the like), the average aperture of the flexible porous metal foil can be smaller and more uniform; and the average aperture of the flexible porous metal foil can be controlled by selecting the pressure.

Another improved preparation method of a porous metal foil which is a sheet made of a metal porous material includes the steps of: (1) preparing muddy paste from raw material powder constituting the metal porous material by using a dispersing agent and a binding agent; (2) pressing the paste to form a homogeneous membrane; and (3) sintering the pressed membrane to obtain the porous metal foil. The method can be used for preparing the first flexible porous metal foil, the second flexible porous metal foil and the third flexible porous metal foil above. Through step (2) of pressing the membrane to improve the stacking density of powder particles in the membrane (by adopting a roll mill, a mold press, an isostatic press or the like), the average aperture of the flexible porous metal foil can be smaller and more uniform; and the average aperture of the flexible porous metal foil can be controlled by selecting the pressure.

A further improved preparation method of a porous metal foil which is a sheet made of a metal porous material includes the steps of: (1) preparing a carrier, wherein the carrier is a foil formed by a certain element or a few elements in the metal porous material for forming the flexible porous metal foil; (2) preparing a viscous suspension from raw material powder of the remaining elements constituting the metal porous material by using a dispersing agent and a binding agent; (3) coating the surface of the carrier with the suspension, and drying the suspension to form a membrane attached to the surface of the carrier; (4) pressing the carrier carrying the membrane to improve the stacking density of powder particles in the membrane; and (5) sintering the carrier carrying the membrane to obtain the porous metal foil. The method can be used for preparing the second flexible porous metal foil and the third flexible porous metal foil above. Through step (4) of pressing the carrier to improve the stacking density of powder particles in the membrane (by adopting a roll mill, a mold press, an isostatic press or the like), the average aperture of the flexible porous metal foil can be smaller and more uniform; and the average aperture of the flexible porous metal foil can be controlled by selecting the pressure.

It should be noted that the above several improved preparation methods of porous metal foils can also use the membrane making fixture and the sintering fixture above. Besides, in the above several improved preparation methods of flexible porous metal foils, the pressure used during pressing can be 5~300 MPa, generally 10~100 MPa. Generally, if the pressure during pressing is higher, the average aperture of the porous metal foil is smaller and more uniform, the integrity and strength of the porous metal foil are higher, but the porosity is smaller.

The present invention will be further described below in combination with accompanying drawings and specific embodiments. Additional aspects and advantages of the present invention will be given partially in the description below, and a part will be obvious from the following description or can be known via practice of the present invention.

DETAILED DESCRIPTION OF THE INVENTION

Figure 1:
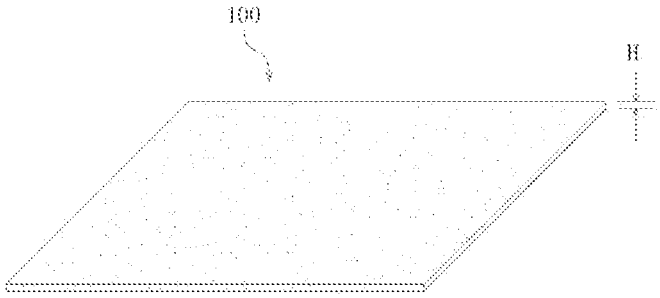
FIG. 1 is an appearance schematic diagram of a rectangular flexible porous metal foil in a specific embodiment of the present invention.

A flexible porous metal foil 100 shown in FIG. 1 is a sheet made of a metal porous material using a solid solution alloy, a face-centered cubic metal element or a body-centered cubic metal element as the matrix phase, the thickness H of the sheet is 5~1500 μm, the average aperture is 0.05~100 μm, and the porosity is 15~70%. The sheet may be rectangular as shown in FIG. 1, and may also be circular, elliptical or in other plane shape.

A preparation method (method 1) of the above flexible porous metal foil 100 includes the steps of: (1) preparing a viscous suspension from raw material powder constituting a metal porous material by using a dispersing agent and a binding agent; (2) injecting the suspension into a mold cavity of a membrane making fixture, and drying the suspension to form a homogeneous membrane; and (3) charging the membrane into a sintering fixture matched with the membrane in shape, then performing constrained sintering, and taking the flexible porous metal foil 100 out of the sintering fixture and obtaining the foil after sintering.

In the above method, the dispersing agent may be an organic solvent which has small surface tension and is quick to volatilize and easy to dry, such as ethanol, methyl ethyl ketone, toluene, etc.; and the binding agent may be PVB (Polyvinyl Butyral), PVA (Polyvinyl Acetate), PVC (Polyvinyl Chloride), polyvinyl alcohol, polyethylene glycol (low molecular wax), paraffin, fatty acid, aliphatic amide, ester, etc.

In the above method, the proportion of the raw material powder and the dispersing agent can be determined according to the specific components of the raw material powder in order to ensure the surface quality of the dried membrane. Generally, if the content of the raw material powder is too high, the surface quality of the dried membrane is poor, and the phenomena of cracking and the like easily occur; and if the content of the raw material powder is too low, the number of injecting the suspension into the mold cavity of the membrane making fixture later is increased, and the preparation cycle of the flexible porous metal foil is prolonged.

In the above method, the proportion of the binding agent and the dispersing agent can be determined according to the specific components of the raw material powder in order to ensure the surface quality of the dried membrane and the strength of the membrane. Generally, if the content of the binding agent is too high, the flowability of the suspension is poor, the defects of pore shrinkage and the like are easily produced after drying, and the de-molding after sintering is difficult; and if the content of the binding agent is too low, the powder particles of the raw material powder cannot be effectively adhered, and the membrane is poor in molding property, low in strength and difficult to be taken out.

In the above method, the constrained sintering means sintering on the premise that the sintering fixture keeps the shape of the membrane, thus preventing the membrane from being deformed in the sintering process. The specific sintering process shall be determined according to the specific components of the raw material powder and the achieved pore structure.

As an improvement on the above method, a step can be added between step (2) and step (3), i.e., pressing the membrane to improve the stacking density of powder particles in the membrane, and then sintering is performed. Specifically, the pressing operation can be realized by adopting a roll mill, a mold press, an isostatic press or the like. The pressing can improve the stacking density of powder particles in the membrane, so that the average aperture of the final prepared flexible porous metal foil can be smaller and more uniform; and the average aperture of the flexible porous metal foil can be controlled by selecting the pressure.

Figure 2:
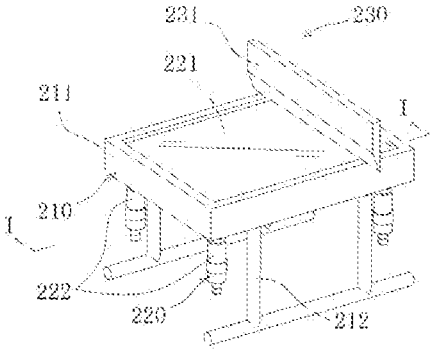
FIG. 2 is a schematic diagram of a three-dimensional structure of a membrane making fixture for preparing the flexible porous metal foil shown in FIG. 1.
Figure 3:
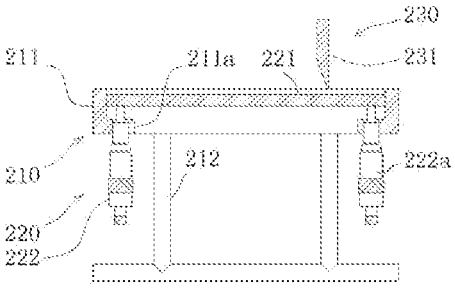
FIG. 3 is a section view of FIG. 2 in the I-I direction.

The membrane making fixture as shown in FIG. 2 and FIG. 3 is used in step 2 of the above method. Specifically, the membrane making fixture includes a fixing portion 210, an adjusting portion 220 and a movable portion 230, wherein the fixing portion 210 includes a mold frame 211 for forming the edge of the membrane, and the mold frame 211 is installed on a supporting base 212 for supporting the mold frame 211 (of course, the mold frame 211 may also be fixed in other manner); the adjusting portion 220 includes a template 221 matched with the mold frame 211 and used for forming the bottom of the membrane, and the template 221 is connected with adjusting devices 222 enabling the template 221 to move in the depth direction of the mold frame 211; and the movable portion 230 includes a scraper 231 positioned at the top surface of the mold frame 211 and having the cutting edge flush with the top surface of the mold frame 211 in the working process. When the flexible porous metal foil 100 is rectangular as shown in FIG. 1, the inner cavity of the mold frame 211 is also rectangular, and the template 221 is located in the inner cavity and matched with the rectangular inner cavity. In addition, each adjusting device 222 specifically can include a height adjusting mechanism 222*a* (e.g., a spiral lifting mechanism below each of four corners of the bottom of the template 221) which is fixed relative to the mold frame 211 and connected with one of four corners of the bottom of the template 221 and works independently. To facilitate the installation of the height adjusting mechanisms 222*a*, supporting structures 211*a* extending inwards are also arranged at the bottom of the mold frame 211, and the height adjusting mechanisms 222*a* are installed on the supporting structures 211*a*.

A using method of the membrane making fixture includes: adjusting the template 221 to a set height and to parallel to the top surface of the mold frame 211 by adjusting each height adjusting mechanism 222*a*, then laying a PET plastic film on the molding surface of the mold frame 211 and the molding surface of the template 221 respectively, injecting the suspension obtained in step (1) into the mold cavity formed by the mold frame 211 and the template 221, next, moving the scraper 231 while ensuring its cutting edge is flush with the top surface of the mold frame 211 to scrape off the suspension on the top surface of the mold frame 211, drying the suspension to form a membrane having uniform thickness, and finally taking the membrane out of the membrane making fixture. The membrane making fixture can accurately control the thickness of the membrane, and ensures the thickness uniformity and surface flatness of the membrane.

Figure 4:
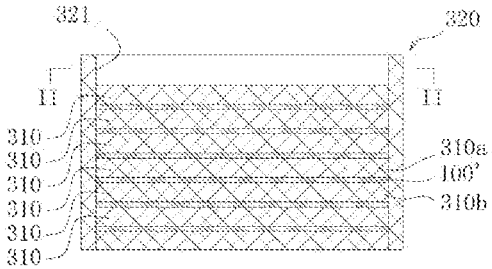
FIG. 4 is a structural schematic diagram of a membrane sintering fixture for preparing the flexible porous metal foil shown in FIG. 1.
Figure 5:
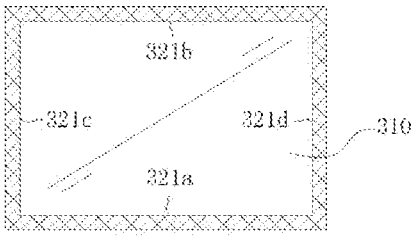
FIG. 5 is a section view of FIG. 4 in the II-II direction.

The membrane sintering fixture as shown in FIG. 4 and FIG. 5 is used in step 3 of the above method. Specifically, the membrane sintering fixture includes an upper mold 310*a*, a lower mold 310*b* and a side mold 320 made of graphite, and the upper mold 310*a* and the lower mold 310*b* are respectively matched with the side mold 320 to form the mold cavity matched with the internal membrane 100'; wherein, the side mold 320 is specifically a mask 321, the upper mold 310*a* and the lower mold 310*b* are respectively clamping plates 310, multiple layers of clamping plates 310 are installed in the mask 321, and the mold cavity is formed between any two adjacent layers of clamping plates 310; besides, a fit clearance for emitting sintered volatile matters is reserved at the fit part of each clamping plate 310 and the mask 321. When the flexible porous metal foil 100 is rectangular as shown in FIG. 1, the side of the mask 321 is of a rectangular structure formed by a front plate 321*a*, a rear plate 321*b*, a left plate 321*c* and a right plate 321*d*.

A using method of the membrane sintering fixture includes: arranging an alumina coating on the inner wall of the mask 321 and two side walls of each clamping plate 310 (mixing ethanol, PVB and alumina powder to prepare a viscous alumina powder suspension, and then coating the inner wall of the mask 321 and two side walls of each clamping plate 310 with the alumina powder suspension to form the alumina coating), then laying a bottom clamping plate 310 at the bottom of the mask 321, placing a membrane 100' on the clamping plate 310, laying a second layer of clamping plate 310 on the membrane 100', laying all the remaining clamping plates 310 like this while ensuring a membrane 100' is sandwiched between any two adjacent layers of clamping plates 310, feeding the assembled membrane sintering fixture into a sintering furnace for sintering, and taking the flexible porous metal foil 100 out of the membrane sintering fixture after sintering. The membrane sintering fixture realizes simultaneous constrained sintering of a plurality of membranes 100', thus improving the production efficiency and simultaneously ensuring the sintering consistency.

Another preparation method (method 2) of the above flexible porous metal foil includes the steps of: (1) preparing a carrier, wherein the carrier is a foil formed by a certain element or a few elements in a metal porous material for forming the flexible porous metal foil; (2) preparing a viscous suspension from raw material powder of the remaining elements constituting the metal porous material by using a dispersing agent and a binding agent; (3) coating the surface of the carrier with the suspension, and drying the suspension to form a membrane attached to the surface of the carrier; and (4) charging the carrier carrying the membrane into a sintering fixture matched with the carrier in shape, then performing constrained sintering, and taking the flexible porous metal foil out of the sintering fixture. As an improvement on the method, a step can also be added between step (3) and step (4), i.e., pressing the carrier carrying the membrane to improve the stacking density of powder particles in the membrane, and then sintering is performed. Specifically, the pressing operation can be realized by adopting a roll mill, a mold press, an isostatic press or the like. The pressing can improve the stacking density of powder particles in the membrane, so that the average aperture of the final prepared flexible porous metal foil can be smaller and more uniform; and the average aperture of the flexible porous metal foil can be controlled by selecting the pressure.

In the above method, the dispersing agent may be an organic solvent which has small surface tension and is quick to volatilize and easy to dry, such as ethanol, methyl ethyl ketone, toluene, etc.; and the binding agent may be PVB, PVA, PVC, polyvinyl alcohol, polyethylene glycol (low molecular wax), paraffin, fatty acid, aliphatic amide, ester, etc.

In the above method, the proportion of the raw material powder and the dispersing agent can be determined according to the specific components of the raw material powder in order to ensure the surface quality of the dried membrane. Generally, if the content of the raw material powder is too high, the surface quality of the dried membrane is poor, and the phenomena of cracking and the like easily occur; and if the content of the raw material powder is too low, the number of injecting the suspension into the mold cavity of the membrane making fixture later is increased, and the preparation cycle of the flexible porous metal foil is prolonged.

In the above method, the proportion of the binding agent and the dispersing agent can be determined according to the specific components of the raw material powder in order to ensure the surface quality of the dried membrane and the strength of the membrane. Generally, if the content of the binding agent is too high, the flowability of the suspension is poor, the defects of pore shrinkage and the like are easily produced after drying, and the de-molding after sintering is difficult; and if the content of the binding agent is too low, the powder particles of the raw material powder cannot be effectively adhered, and the membrane is poor in molding property, low in strength and difficult to be taken out.

In the above method, the constrained sintering means sintering on the premise that the sintering fixture keeps the shape of the membrane, thus preventing the membrane from being deformed in the sintering process. The specific sintering process shall be determined according to the specific components of the raw material powder and the achieved pore structure. This method still uses the membrane sintering fixture in "method 1".

The suspension can be attached to the surface of the carrier by coating or the like in step 3 of the above method, but it is suggested that the suspension is attached to the surface of the carrier by using the membrane making fixture shown in FIG. 2 and FIG. 3. The specific method includes: adjusting the template 221 to a set height and to parallel to the top surface of the mold frame 211 by adjusting each height adjusting mechanism 222*a*, then laying a carrier on the template 221, injecting the suspension obtained in step (2) into the mold cavity between the mold frame 211 and the carrier, next, moving the scraper 231 while ensuring its cutting edge is flush with the top surface of the mold frame 211 to scrape off the suspension on the top surface of the mold frame 211, drying the suspension to form a membrane having uniform thickness, and finally taking the carrier carrying the membrane out of the membrane making fixture.

A further preparation method (method 3) of the above flexible porous metal foil includes the steps of: (1) preparing muddy paste from raw material powder constituting the metal porous material by using a dispersing agent and a binding agent; (2) pressing the paste to form a homogeneous membrane; and (3) sintering the pressed membrane to obtain the flexible porous metal foil. In this method, the dispersing agent may be an organic solvent which has small surface tension and is quick to volatilize and easy to dry, such as ethanol, methyl ethyl ketone, toluene, etc.; and the binding agent may be PVB, PVA, PVC, polyvinyl alcohol, polyethylene glycol (low molecular wax), paraffin, fatty acid, aliphatic amide, ester, etc. The steps of "method 3" are fewer than those of "method 1" and "method 2", so the production efficiency is high, and the quality of the prepared flexible porous metal foil is very ideal. Specifically, the pressing operation can be realized by adopting a roll mill, a mold press, an isostatic press or the like. The pressing can improve the stacking density of powder particles in the membrane, so that the average aperture of the final prepared flexible porous metal foil is smaller and more uniform; and the average aperture of the flexible porous metal foil can be controlled by selecting the pressure. This method also uses the membrane sintering fixture in "method 1".

Embodiment 1

The flexible porous metal foil 100 is a rectangular sheet made of a Ni—Cu solid solution alloy porous material, the thickness H of the sheet is 10 μm, the length is 160 mm, the width is 125 mm, the average aperture is 18.4 μm, and the porosity is 58.37%. A preparation method of the flexible porous metal foil 100 includes the steps of: firstly, mixing Ni powder and Cu powder uniformly to form raw material powder, wherein the mass of the Cu powder is 30% of the mass of the raw material powder; then taking ethanol as a dispersing agent and PVB as a binding agent, adding the PVB into the ethanol in a mass ratio of 2.5:100 to form a PVB solution, adding the raw material powder into the PVB solution according to a proportion of adding 25 g of raw material powder into per 100 ml of ethanol, and dispersing the raw material powder uniformly by stirring to obtain a viscous suspension; secondly, injecting the suspension into the mold cavity of the membrane making fixture shown in FIG. 2 and FIG. 3, and drying the suspension to form a homogeneous membrane 100'; and finally, charging the membrane 100' into the membrane sintering fixture shown in FIG. 4 and FIG. 5, performing a specific sintering process of gradually raising the sintering temperature to 550° C. and holding 90 mins (this process is mainly used for removing the binding agent, Vaseline, etc.), then directly raising the temperature to 1130° C. at the heating rate of 6° C./min and holding 180 mins (when the temperature is quickly raised to 1170° C. and exceeds the melting point of Cu, the Ni powder can be driven by using the flowability after the Cu is melted, so that the Ni powder is sufficiently combined, and the integrity and flexibility of the flexible porous metal foil 100 are ensured), and taking the flexible porous metal foil 100 out of the sintering fixture after sintering.

Embodiment 2

The flexible porous metal foil 100 is a rectangular sheet made of a Ni—Cu solid solution alloy porous material, the thickness H of the sheet is 100 μm, the length is 200 mm, the width is 130 mm, the average aperture is 30 μm, and the porosity is 61.68%. A preparation method of the flexible porous metal foil 100 includes the steps of: firstly, mixing Ni powder and Cu powder uniformly to form raw material powder, wherein the mass of the Cu powder is 60% of the mass of the raw material powder; then taking ethanol as a dispersing agent and PVB as a binding agent, adding the PVB into the ethanol in a mass ratio of 4:100 to form a PVB solution, adding the raw material powder into the PVB solution according to a proportion of adding 40 g of raw material powder into per 100 ml of ethanol, and dispersing the raw material powder uniformly by stirring to obtain a viscous suspension; secondly, injecting the suspension into the mold cavity of the membrane making fixture shown in FIG. 2 and FIG. 3, and drying the suspension to form a homogeneous membrane 100'; and finally, charging the membrane 100' into the membrane sintering fixture shown in FIG. 4 and FIG. 5, performing a specific sintering process of gradually raising the sintering temperature to 550° C. and holding 90 min, then directly raising the temperature to 1180° C. at the heating rate of 8° C./min and holding 180 min, and taking the flexible porous metal foil 100 out of the sintering fixture after sintering.

Embodiment 3

The flexible porous metal foil is a rectangular sheet made of a Ni—Cu solid solution alloy porous material, the thickness H of the sheet is 60 μm, the length is 150 mm, the width is 100 mm, the average aperture is 54.1 μm, and the porosity is 40.16%. A preparation method of the flexible porous metal foil includes the steps of: firstly, performing surface treatment on a Cu foil (carrier) having the purity more than 99% and the thickness of 10 μm: cleaning impurities such as oil stains and the like on the surface of the Cu foil by adopting 10% NaOH solution, and then performing acid washing on the Cu foil in 10% $H_2SO_4$ solution for 2 mins to remove oxides and rust stains on the surface of the Cu foil; secondly, soaking the Cu foil after alkali washing and acid washing into an acetone solution, cleaning the Cu foil with ultrasonic for 8 mins, drying the Cu foil in a vacuum oven, and recording the mass of the Cu foil; thirdly, taking elemental Ni powder as a raw material, ethanol as a dispersing agent and PVB as a binding agent, adding the PVB into the ethanol in a mass ratio of 4:100 to prepare a PVB solution, then adding Ni powder into the PVB solution according to a proportion of adding 25 g of Ni powder into per 100 ml of ethanol, and dispersing the Ni powder uniformly by stirring to obtain a viscous suspension; and finally, sticking the Cu foil to the surface of the template 221 of the membrane making fixture, controlling the membrane laminating thickness by adjusting the height of the top surface of the template 221, then injecting the suspension into the mold cavity of the membrane making fixture, controlling the mass ratio of Ni to Cu to about 1:1, drying the suspension, charging the dried blank into the membrane sintering fixture shown in FIG. 4 and FIG. 5, and sintering the blank according to the same sintering process of embodiment 1.

Embodiment 4

The flexible porous metal foil 100 is a rectangular sheet made of a Ni—Cu solid solution alloy porous material, the thickness H of the sheet is 10 μm, the length is 160 mm, the width is 125 mm, the average aperture is 1.2 μm, and the porosity is 42.5%. A preparation method of the flexible porous metal foil 100 includes the steps of: firstly, mixing Ni powder and Cu powder uniformly to form raw material powder, wherein the mass of the Cu powder is 30% of the mass of the raw material powder; then taking ethanol as a dispersing agent and PVB as a binding agent, adding the PVB into the ethanol in a mass ratio of 2.5:100 to form a PVB solution, adding the raw material powder into the PVB solution according to a proportion of adding 25 g of raw material powder into per 100 ml of ethanol, and dispersing the raw material powder uniformly by stirring to obtain a viscous suspension; secondly, injecting the suspension into the mold cavity of the membrane making fixture shown in FIG. 2 and FIG. 3, and drying the suspension to form a homogeneous membrane 100'; thirdly, putting the membrane 100' onto a roll mill and rolling the membrane 100' under 10 MPa at the rolling speed of 600 r/min (revolving speed of a roll); and finally, charging the rolled membrane 100' into the membrane sintering fixture shown in FIG. 4 and FIG. 5, performing a specific sintering process of gradually raising the sintering temperature to 550° C. and holding 90 mins (this process is mainly used for removing the binding agent, Vaseline, etc.), then directly raising the temperature to 1130° C. at the heating rate of 6° C./min and holding 180 mins (when the temperature is quickly raised to 1170° C. and exceeds the melting point of Cu, the Ni powder can be driven by using the flowability after the Cu is melted, so that the Ni powder is sufficiently combined, and the integrity and flexibility of the flexible porous metal foil 100 are ensured), and taking the flexible porous metal foil 100 out of the sintering fixture after sintering.

Embodiment 5

The flexible porous metal foil is a rectangular sheet made of a Ni—Cu solid solution alloy porous material, the thickness H of the sheet is 60 μm, the length is 150 mm, the width is 100 mm, the average aperture is 25 μm, and the porosity is 37%. A preparation method of the flexible porous metal foil includes the steps of: firstly, performing surface treatment on a Cu foil (carrier) having the purity more than 99% and the thickness of 10 μm: cleaning impurities such as oil stains and the like on the surface of the Cu foil by adopting 10% NaOH solution, and then performing acid washing on the Cu foil in 10% $H_2SO_4$ solution for 2 mins to remove oxides and rust stains on the surface of the Cu foil; secondly, soaking the Cu foil after alkali washing and acid washing into an acetone solution, cleaning the Cu foil with ultrasonic for 8 min, drying the Cu foil in a vacuum oven, and recording the mass of the Cu foil; thirdly, taking elemental Ni powder as a raw material, ethanol as a dispersing agent and PVB as a binding agent, adding the PVB into the ethanol in a mass ratio of 4:100 to prepare a PVB solution, then adding Ni powder into the PVB solution according to a proportion of adding 25 g of Ni powder into per 100 ml of ethanol, and dispersing the Ni powder uniformly by stirring to obtain a viscous suspension; and finally, sticking the Cu foil to the surface of the template 221 of the membrane making fixture, controlling the membrane laminating thickness by adjusting the height of the top surface of the template 221, then injecting the suspension into the mold cavity of the membrane making fixture, controlling the mass ratio of Ni to Cu to about 1:1, drying the suspension, putting the dried blank onto a roll mill, rolling the blank under 15 MPa at the rolling speed of 300 r/min (revolving speed of a roll), then charging the blank into the membrane sintering fixture shown in FIG. 4 and FIG. 5, and performing sintering according to the same sintering process of embodiment 1.

Embodiment 6

The flexible porous metal foil 100 is a rectangular sheet made of a Ni—Cu solid solution alloy porous material, the thickness H of the sheet is 500 μm, the length is 160 mm, the width is 125 mm, the average aperture is 15.2 μm, and the porosity is 51%. A preparation method of the flexible porous metal foil 100 includes the steps of: firstly, mixing Ni powder and Cu powder uniformly to form raw material powder, wherein the mass of the Cu powder is 30% of the mass of the raw material powder; then taking ethanol as a dispersing agent and PVB as a binding agent, preparing a muddy paste according to a proportion of 30 g of PVB and 500 g of raw material powder per 100 ml of ethanol; secondly, putting the paste onto a roll mill and rolling the paste under 25 MPa at the rolling speed of 200 r/min (revolving speed of a roll); and finally, charging the rolled membrane 100' into the membrane sintering fixture shown in FIG. 4 and FIG. 5, performing a specific sintering process of gradually raising the sintering temperature to 550° C. and holding 90 min, then directly raising the temperature to 1130° C. at the heating rate of 6° C./min and holding 180 mins (when the temperature is quickly raised to 1170° C. and exceeds the melting point of Cu, the Ni powder can be driven by using the flowability after the Cu is melted, so that the Ni powder is sufficiently combined, and the integrity and flexibility of the flexible porous metal foil 100 are ensured), and taking the flexible porous metal foil 100 out of the sintering fixture after sintering.

Embodiment 7

Based on embodiment 1, the thickness H of the sheet is increased to 300 μm in embodiment 7.

Embodiment 8

Based on embodiment 4, the thickness H of the sheet is increased to 500 μm in embodiment 8.

Embodiment 9

Based on embodiment 5, the thickness H of the sheet is increased to 800 μm in embodiment 9.

The performance comparison results of the flexible porous metal foils of embodiments 1-9 are shown as Table 1.

TABLE 1

Performance Comparison Results of Flexible Porous Metal Foils

| Item | Embodiment 1 | Embodiment 2 | Embodiment 3 | Embodiment 4 | Embodiment 5 | Embodiment 6 | Embodiment 7 | Embodiment 8 | Embodiment 9 |
|---|---|---|---|---|---|---|---|---|---|
| Surface plane runout of foil (flatness) | ≤0.36 μm | ≤0.56 μm | ≤5 μm | ≤0.09 μm | ≤0.15 μm | ≤0.06 μm | ≤9.38 | ≤1.64 | ≤2.24 |
| Aperture distribution | X ≤ 10 μm | 15% | 15% | 10% | 7% | 11% | 5% | 8% | 6% |
| | 10 μm < X < 80 μm | 85% | 70% | 50% | 91% | 86% | 93% | 87% | 92% |
| | X ≥ 80 μm | 5% | 15% | 40% | 2% | 3% | 2% | 5% | 2% |
| Folding endurance of foil | Folded 16 times | Folded 14 times | Folded 7 times | Folded 25 times | Folded 21 times | Folded 28 times | Folded 7 times | Folded 12 times | Folded 10 times |

We claim:

1. A method of making a flexible porous metal foil characterized as a sheet having a matrix phase made of a metal porous material, wherein the metal porous material is a solid solution alloy, a face-centered cubic metal element, or a body-centered cubic metal element, wherein the thickness of the sheet is more than 200 μm and less than or equal to 1500 μm, average aperture of the sheet is 0.05~100 μm, and porosity of the sheet is 15~70%, the method comprising:

(1) cleaning a Cu foil having purity exceeding 99% and thickness of 10 μm;

(2) preparing a paste using dispersing agent, binding agent, and raw material powder that will form the metal porous material;

(3) sticking the Cu foil to a surface of a mold for making a membrane;

(4) injecting the paste into the mold after sticking the Cu foil to the surface of the mold and leaving the paste to dry into a homogeneous membrane;

(5) pressing the homogenous membrane to improve stacking density of powder particles in the membrane, thus forming a pressed membrane; and (6) sintering the pressed membrane to obtain the flexible porous metal foil, wherein the raw material powder consists of Ni; and a mass of the Cu foil is approximately equal to a mass of the raw material powder in the paste injected into the mold.

2. The method of making a flexible porous metal foil of claim 1, wherein the dispersing agent is ethanol and the binding agent is PVB in a ratio of 4:100 (PVB:ethanol), and the paste consists of 25 g of Ni powder per 100 ml of ethanol.

3. A method of making a flexible porous metal foil characterized as a sheet having a matrix phase made of a metal porous material, wherein the metal porous material is a solid solution alloy, a face-centered cubic metal element, or a body-centered cubic metal element, wherein the thickness of the sheet is more than 200 μm and less than or equal to 1500 μm, average aperture of the sheet is 0.05~100 μm, and porosity of the sheet is 15~70%, the method comprising:

(1) preparing a paste using dispersing agent, binding agent, and raw material powder that will form the metal porous material;

(2) injecting the paste into a mold for making membrane and leaving the paste to dry into a homogeneous membrane;

(3) pressing the homogenous membrane to improve stacking density of powder particles in the membrane, thus forming a pressed membrane; and (4) sintering the pressed membrane to obtain the flexible porous metal foil, and wherein the mold comprises:

a mold frame for forming an edge of the flexible metal foil;

a template matched to the mold frame and adjustable in a depth direction within the mold frame to set a thickness of the flexible metal foil; and a scraper to set a top surface of the paste flush with a top edge of the mold frame.

4. A method of making a flexible porous metal foil characterized as a sheet having a matrix phase made of a metal porous material, wherein the metal porous material is a solid solution alloy, a face-centered cubic metal element, or a body-centered cubic metal element, wherein the thickness of the sheet is more than 200 μm and less than or equal to 1500 μm, average aperture of the sheet is 0.05~100 μm, and porosity of the sheet is 15~70%, the method comprising:

(1) preparing a paste using dispersing agent, binding agent, and raw material powder that will form the metal porous material;

(2) injecting the paste into a mold for making membrane and leaving the paste to dry into a homogeneous membrane;

(3) pressing the homogenous membrane to improve stacking density of powder particles in the membrane, thus forming a pressed membrane; and (4) sintering the pressed membrane to obtain the flexible porous metal foil, and wherein the mold comprises:

an upper mold;

a lower mold;

a side mold; and at least three layers of clamping plates so that a plurality of pressed membranes can be sintered simultaneously.

* * * * *